US005735317A

United States Patent [19]

Wu

[11] Patent Number: 5,735,317

[45] Date of Patent: Apr. 7, 1998

[54] SEALED CONTAINER AND SUCTION PUMP UNIT

[75] Inventor: Mao Sheng Wu, Taipei, Taiwan

[73] Assignee: Enrichwell Enterprise Co., Ltd., Taipei, Taiwan

[21] Appl. No.: 734,034

[22] Filed: Oct. 18, 1996

[51] Int. Cl.[6] ..... B65B 31/04

[52] U.S. Cl. ..... 141/65; 215/228; 251/65; 137/550; 220/203.07

[58] Field of Search ..... 141/65, DIG. 1; 137/550; 251/65, 339; 215/228, 260, 262, 270; 220/203.07, 203.28, 212, 230; 417/545, 234, 554

[56] References Cited

U.S. PATENT DOCUMENTS

| | | | |
|---|---|---|---|
| 4,051,971 | 10/1977 | Saleri et al. | 215/228 |
| 5,002,090 | 3/1991 | Ichikawa et al. | 137/550 |
| 5,390,809 | 2/1995 | Lin | 141/65 |
| 5,449,079 | 9/1995 | Yang | 141/65 |

*Primary Examiner*—David J. Walczak
*Assistant Examiner*—Timothy L. Maust
*Attorney, Agent, or Firm*—Bacon & Thomas

[57] ABSTRACT

A sealed container and suction pump unit including a sealed container, and a suction pump adapted for drawing air out of the sealed container, the suction pump having a vacuum mount adapted for securing to the container body of the sealed container, and a bottom coupling groove adapted for coupling to the container cover of the container body of the sealed container, the container cover of the sealed container having a center air hole through which air can be drawn out of the container body by the suction pump, an upward coupling flange raised around the center air hole and adapted for engaging the bottom coupling groove, an air filter element mounted in the center air hole to remove solid particles from air passing through, a metal pressure plate supported on a seal ring inside the center air hole and attracted by a magnet to seal the air passage, and a press member mounted in the center air hole and controlled to tilt the metal pressure plate in opening the air passage.

5 Claims, 6 Drawing Sheets

SEALED CONTAINER AND SUCTION PUMP UNIT

BACKGROUND OF THE INVENTION

The present invention relates to sealed containers, and relates more particularly to such a sealed container which can be drawn into a vacuum status by an attached suction pump, and maintained in the vacuum status for preserving food for a long period of time.

A regular sealed container, as shown in FIG. 1, is generally comprised of a container body, and a cover covered on the container body to seal its top opening. This structure of sealed container cannot be used fox preserving eatable things for a long period of time because the container body is not maintained in a vacuum status. When the cover is covered on the container body, there is a certain volume of air inside the container body, and the moisture carried in air inside the container body deteriorates eatable things quickly.

SUMMARY OF THE INVENTION

The present invention has been accomplished to provide a sealed container which eliminates the aforesaid problem. It is the main object of the present invention to provide a sealed container which can be maintained in a vacuum status for preserving things for a long period of time. According to the preferred embodiment of the present invention, the sealed container and suction pump unit comprises a sealed container, and a suction pump adapted for drawing air out of the sealed container, the suction pump having a vacuum mount adapted for securing to the container body of the sealed container, the container cover of the sealed container having a center air hole through which air can be drawn out of the container body by the suction pump, an air filter element mounted in the center air hole to remove solid particles from air passing through, a metal pressure plate supported on a seat ring inside the center air hole and attracted by a magnet to seal the air passage, and a press member mounted in the center air hole and controlled to tilt the metal pressure plate in opening the air passage.

DESCRIPTION OF REFERENCE NUMBERS

| | | | |
|---|---|---|---|
| 100 | Suction pump | 101 | Vacuum mount |
| 102 | Finger strip | 200 | Sealed container |
| 201 | Container cover | 201a | Container body |
| 202 | Center air hole | 203 | Tubular downward flange |
| 204 | Carrier flange | 204a | Convex portion |
| 204b | Annular groove | 204c | Center recess |
| 205d | Air hole | 205 | Cup |
| 206 | Filter element | 207 | Partition rib |
| 208 | Magnet | 209 | Seal ring |
| 210 | Metal pressure plate | 211 | Press member |
| 211a | Springy flap | 211b | Press lever |
| 212 | Mounting groove | 213 | Packing strip |
| 214 | Coupling groove | 215 | Coupling flange |

DETAILED DESCRIPTION OF THE PREFERRED EMBODIMENT

Figure 1:
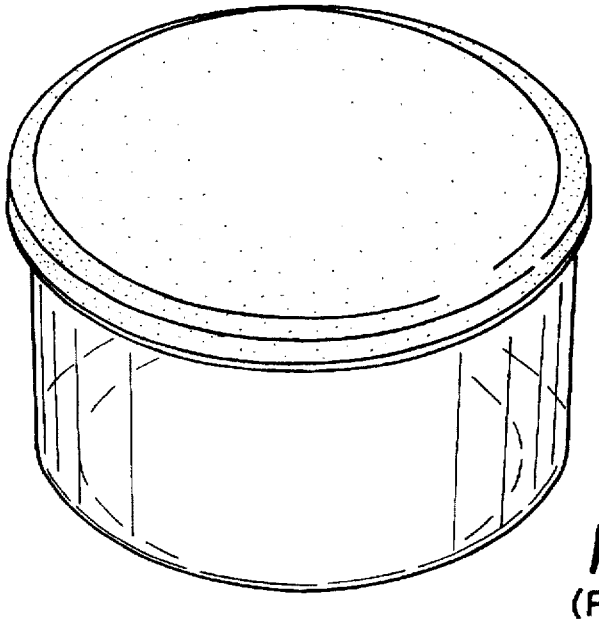
FIG. 1 (PRIOR ART)
FIG. 1 is a perspective elevational view of a sealed container according to the prior art.
Figure 2C:
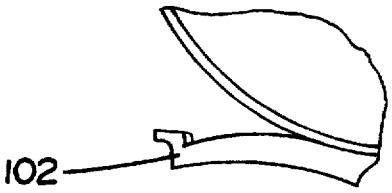
FIG. 2 is a perspective elevational view of a sealed container and suction pump unit according to the present invention.
Figure 2B:
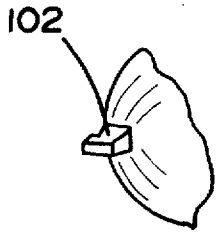
Figure 2A:
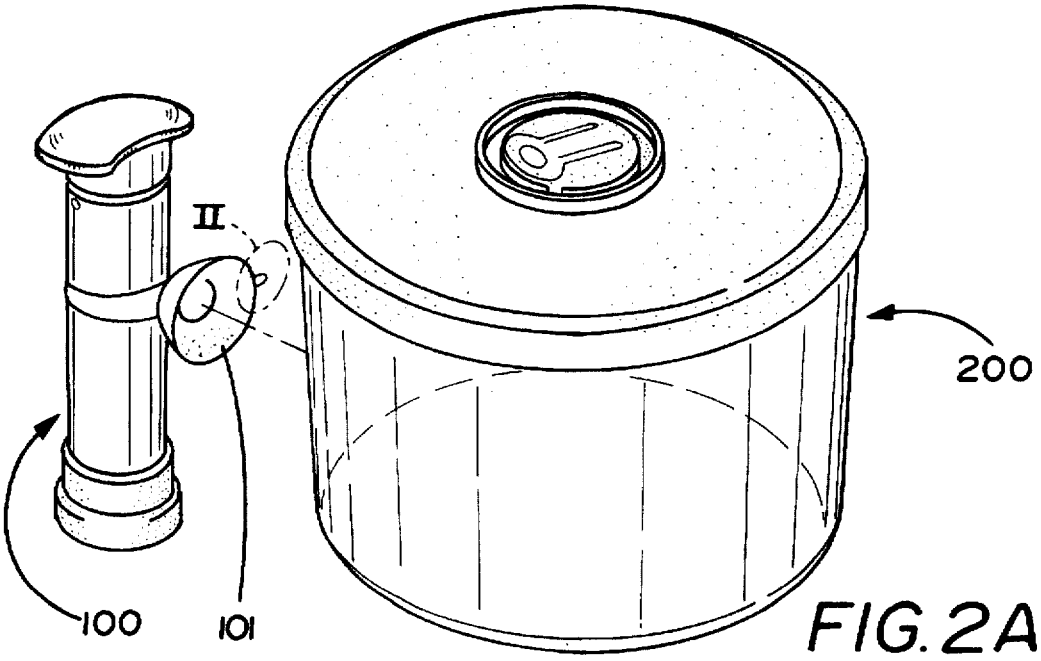
Figure 11A:
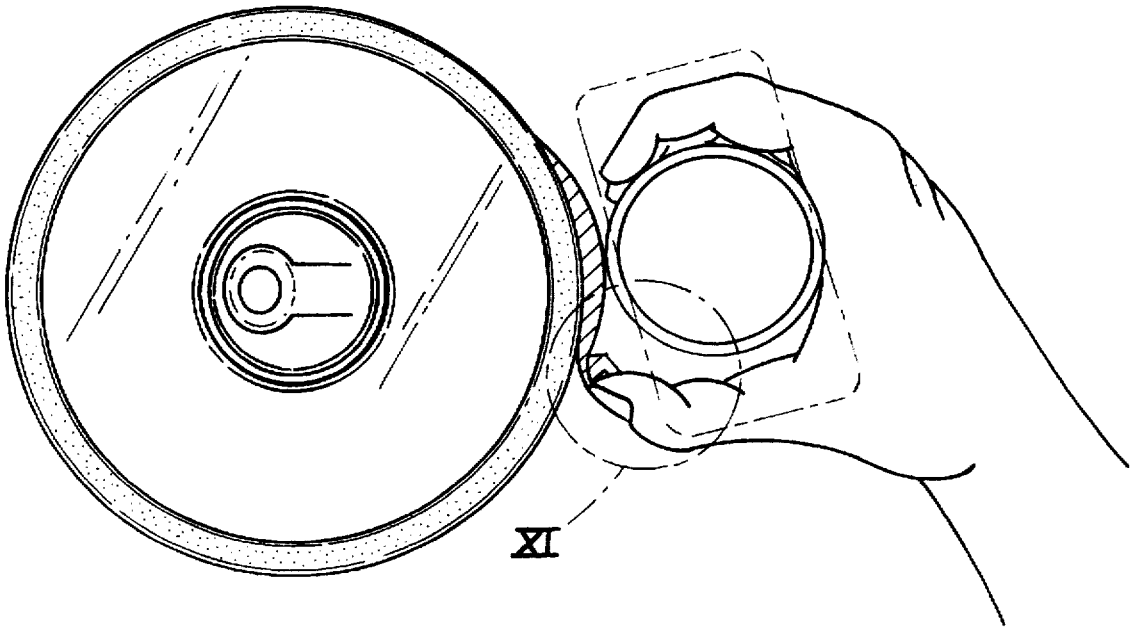
Figure 11B:
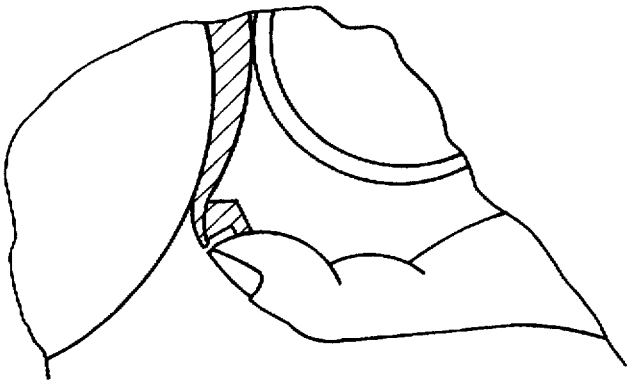

Referring to FIG. 2, the present invention comprises a suction pump 100, and a sealed, container 200. The suction pump has a cylindrical shape, and a vacuum mount 101 at the periphery adapted for securing to the periphery of the sealed container 200. The vacuum mount 101 has a finger strip 102 raised from the periphery through which the vacuum mount 101 can be conveniently detached from the sealed container 200. As illustrated in FIG. 11, when the user holds the suction pump 100 in hand, the finger strip 102 is turned with fingers to lift the rim of the vacuum mount 101 from the periphery of the sealed container 200, and the vacuum mount 101 is easily detached from the sealed container 200.

Figures 3A, 3B:
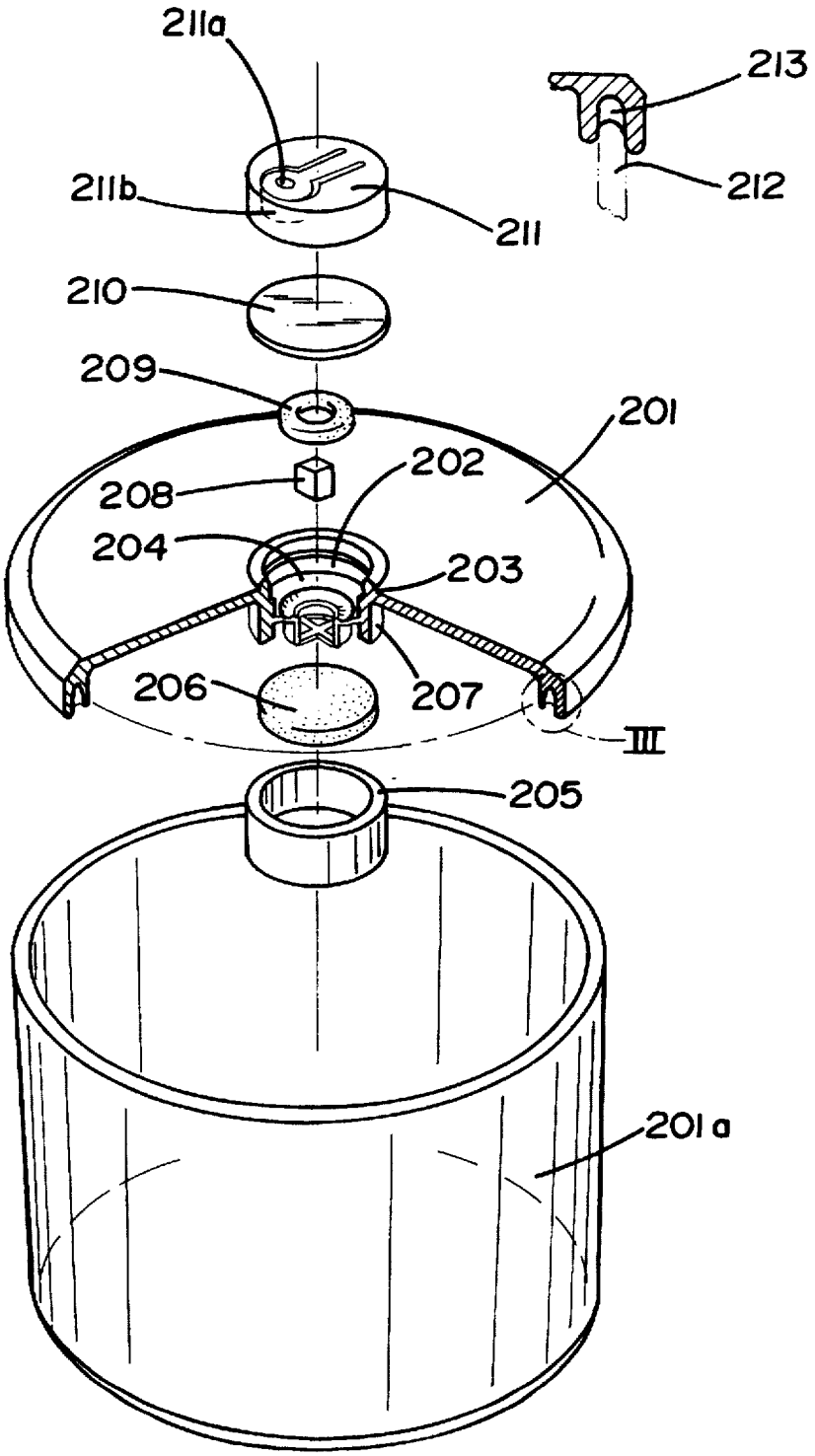
FIG. 3 is an exploded view of the sealed container shown in FIG. 2.
Figure 4B:
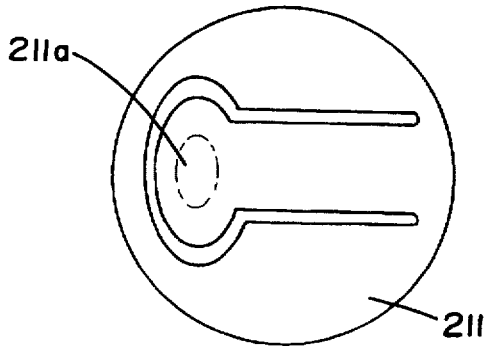
FIG. 4 is a sectional view of the center part of the container cover according to the present invention.
Figure 4A:
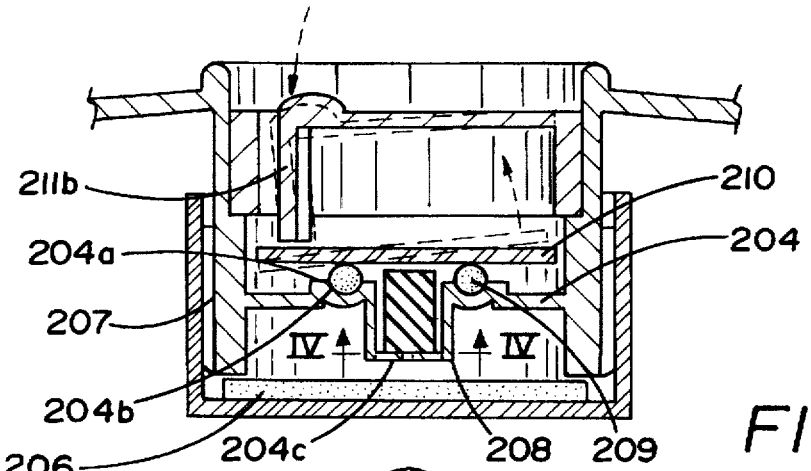
Figure 4C:
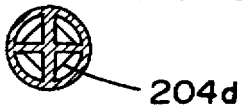

Referring to FIGS. 3 and 4, the sealed container 200 is comprised of a top-open container body 201*a*, and a container cover 201 cowered on the container body 201*a*. The container cover 201 comprises a center air hole 201 at the center, a tubular downward flange 203 perpendicularly raised from the inside around the center air hole 202, a carrier flange 204 suspended inside the tubular down, ward flange 203, a plurality of equiangularly spaced partition ribs 207 raised around the tubular downward flange 203 on the outside, a cup 205 mounted on the tubular downward flange 203 and covered around the partition ribs 207, an air filter element 206 mounted within the cup 205 and stopped between the cup 205 and the tubular downward flange 203, a magnet 208 mounted on the carrier flange 204 within the tubular downward flange 203, a press member 211 mounted in the center air hole 202, a seal ring 209 mounted on the carrier flange 204 within the tubular downward flange 203 around the magnet 208, a metal pressure plate 210 mounted in the center air hole 202 and stopped between the seal ring 209 and the press member 211, a downward mounting groove 212 disposed around the border and adapted for coupling to the top rim of the container body 201*a*, and a packing strip 213 mounted in the downward mounting groove 212 for sealing the gap between the container cover 201 and the container body 201*a*. The press member 211 comprises a horizontal springy flap 211*a* at the center, and a vertical press lever 211*b* extended from one end of the horizontal springy flap 211*a* at right angles and pressed on a border area of the metal pressure plate 210.

Referring to FIG. 4 again, the carrier flange 204 comprises a center recess 204*c* which holds the magnet 208, a convex portion 204*a* raised around the center-recess 204*c*, an annular groove 204*b* formed in the convex portion 204*a* around the center recess 204*c* which holds the seal ring 209, and a plurality of air holes 204*d* through the bottom of the center recess 204*c* (see FIG. 4 a—a section).

Figure 9:
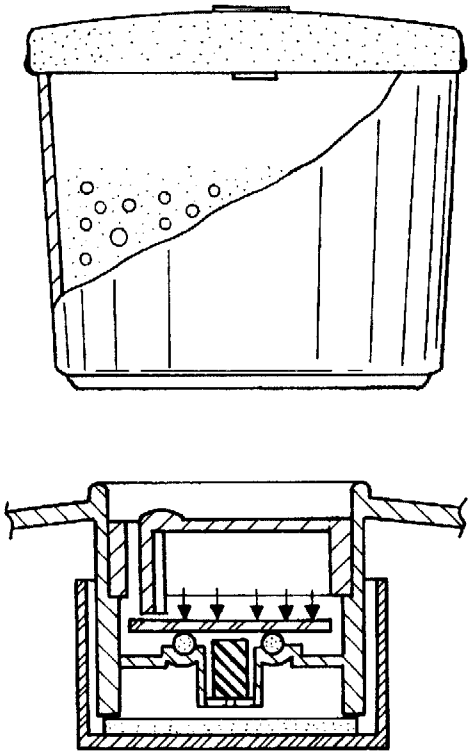
FIG. 9 shows the metal pressure plate attracted by the magnet, and the air passage sealed according to the present invention.

Referring to FIG. 9 and FIG. 4 again, the magnet 208 attracts the metal pressure plate 210, causing it to be firmly retained to the seal ring 209, and therefore the air passage through the air holes 204*d* is closed. When the air holes 204*d* are closed, outside air is prohibited from passing to the inside of the container body 201*a*.

Figure 10:
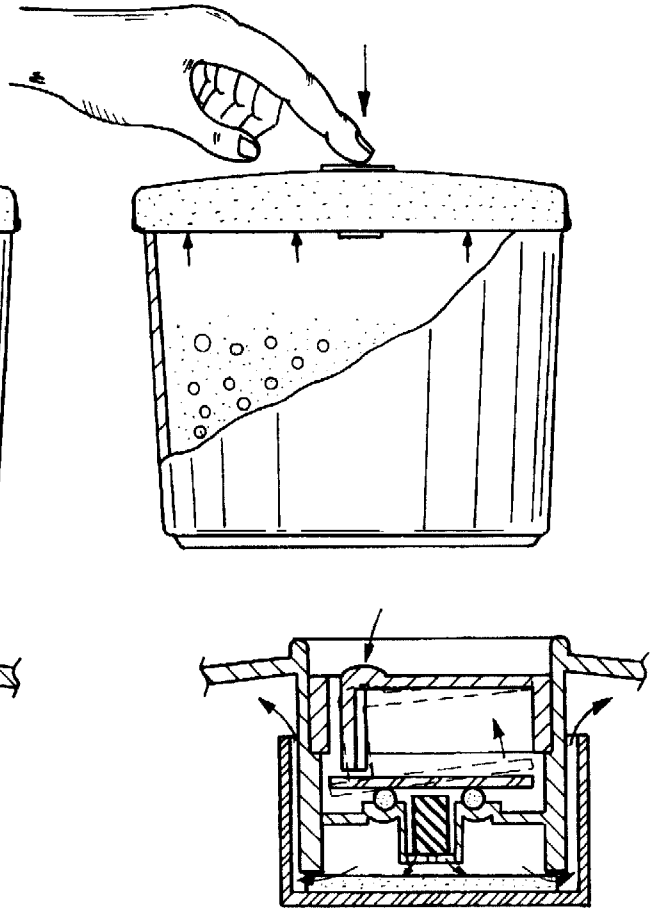
FIG. 10 is another applied view of the present invention, showing the press member depressed, the metal pressure plate tilted, and the air passage opened; and, FIG. 11 is still another applied view of the present invention, showing the finger strip of the vacuum mount pulled, and the vacuum mount deformed.

Referring to FIG. 10 and FIG. 4 again, when the springy flap 211*a* of the press member 211 is depressed, the press lever 211*b* is lowered to force the meal pressure plate 210 to tilt. When the metal pressure plate 210 is tilted, the air passage through the air holes 204*d* is opened, and therefore outside air is allowed to pass through the center air hole 202, the air holes 204*d*, the air filter element 206 and the gaps between the ribs 207 and the cup 205, to the inside of the container body 201*a*. When air passes to the inside of the container body 201*a*, the vacuum status of the container body 201*a* is disappeared, and the container cover 201 can be easily detached from the container body 201*a*.

Figure 5:
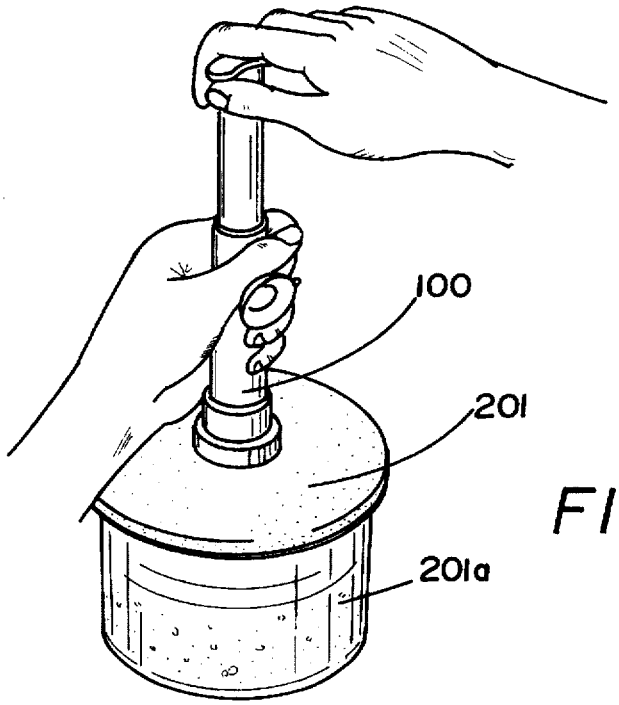
FIG. 5 shows the suction pump attached to the center air hole of the container cover and operated according to the present invention.
Figure 8:
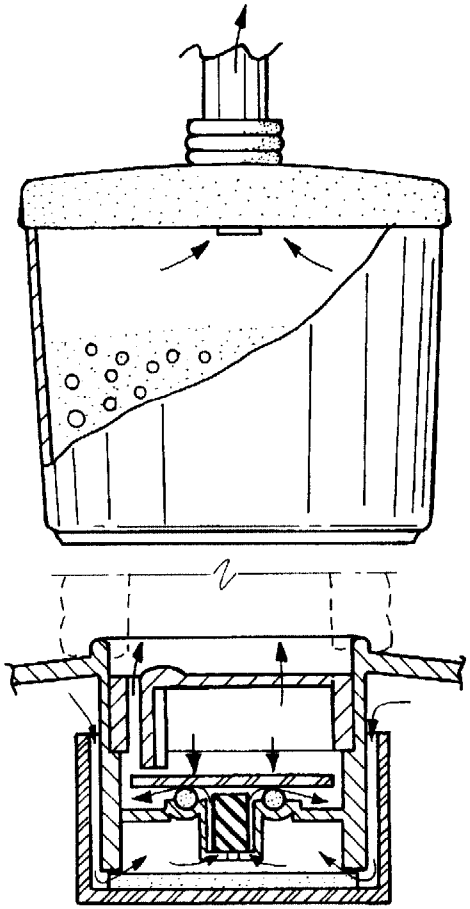
FIG. 8 is an applied view of the present invention, showing air drawn out of the container body through the center air hole of the container cover.

Referring to FIGS. 5 and 8, When the suction pump 100 is disconnected from the container body 201*a* and attached to the center air hole 202 of the container cover 201, it is operated to draw air out of the container body 201*a*, so that the container body 201*a* can be maintained in a vacuum status. When the suction pump 100 is operated to draw air out of the container body 201*a*, the suction force pulls the metal pressure plate 210 upwards, causing it to be released from the attractive force of the magnet 208, and therefore the air holes 204*d* are opened for permitting air to be drawn out of the container body 201*a* to the outside.

Figure 6:
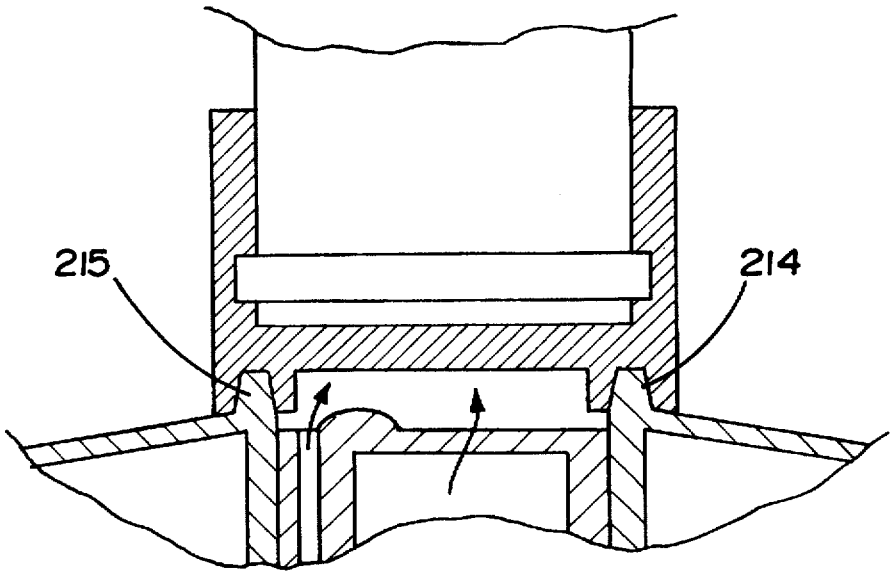
FIG. 6 is a sectional view of a part of the present invention, showing the bottom coupling groove of the suction pump coupled to the upward coupling flange of the container cover.
Figure 7:
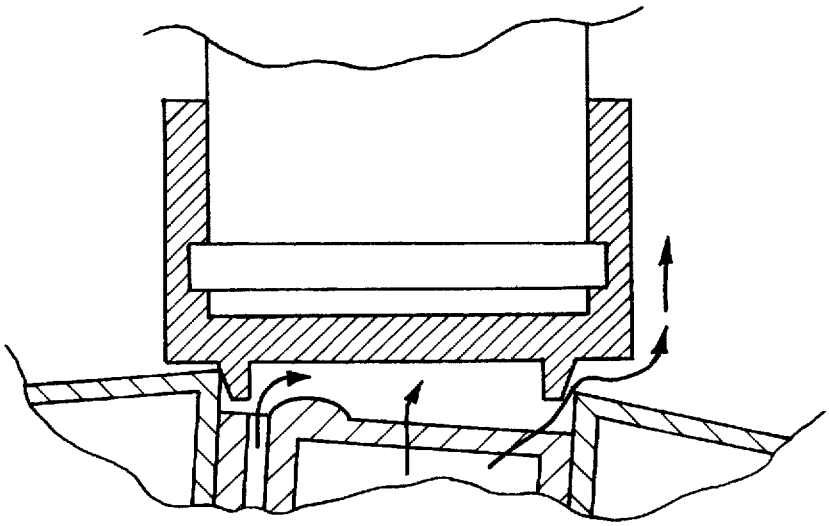
FIG. 7 is a sectional view showing the connection between a conventional suction pump and the center air hole of the container cover.

Referring to FIG. 6 and FIG. 5 again, the suction pump 100 has a bottom coupling groove, 214 adapted for engaging with an upward coupling flange 215, which is raised from the cover 201 at the top around the center air hole 202. Therefore, when the suction pump 100 is attached to the center air hole 202 of the cover 201, no air leakage will occur. In case the suction pump has only a downward coupling flange adapted for fitting into the center air hole of the cover of the sealed container, the suction pump may be tilted during its operation, causing an air leakage (see FIG. 7). The design of the suction pump 100 of the present invention eliminates this problem.

While only one embodiment of the present invention has been shown and described, it will be understood that various modifications and changes could be made thereunto without departing from the spirit and scope of the invention disclosed.

What the invention claimed is:

1. A sealed container and suction pump unit comprising a sealed container and a suction pump adapted for drawing air out of said sealed container, said sealed container comprises a top-open container body having a top rim, and a container cover fastened to the top rim of said container body to seal said container body, wherein said container cover comprises a center air hole at the center, a tubular downward flange perpendicularly raised from the inside around said center air hole, a carrier flange suspended inside said tubular downward flange, a plurality of equiangularly spaced partition ribs raised around said tubular downward flange on the outside, a cup mounted on said tubular downward flange and covered around said partition ribs, an air filter element mounted within said cup and stopped between said tubular downward flange and said cup, a magnet mounted on said, carrier flange within said tubular downward flange, a press member mounted in said center air hole, a seal ring mounted on said carrier flange within said tubular downward flange around said magnet, an air passage disposed in communication between said center air hole and the inside of said container body, a metal pressure plate mounted in said center air hole and supported on said seal ring below said press member and attracted by said magnet to close said air passage, a downward mounting groove disposed around the border and adapted for coupling to the top rim of said container body, and a packing strip mounted in said downward mounting groove for sealing the gap between said cover and said container body, said press member comprising a horizontal springy flap at the center, and a vertical press lever extended from one end of said horizontal springy flap at right angles and pressed on a border area of said metal pressure plate and forced by said springy flap to tilt said metal pressure plate, causing it to open said air passage.

2. The sealed container and suction pump unit of claim 1 wherein said carrier flange of said container cover comprises an annular convex portion at the center, and an annular groove formed in said convex portion and adapted for holding said seal ring.

3. The sealed container and suction pump unit of claim 2 wherein said carrier flange of said container cover further comprises a center recess defined within said convex portion and adapted for holding said magnet.

4. The sealed container and suction pump unit of claim 1 wherein said suction pump comprises a vacuum mount at the periphery adapted for securing to the periphery of said container body, said vacuum mount having a finger strip raised from the periphery on the outside through which said vacuum mount can be pulled away from the periphery of said container body.

5. The sealed container and suction pump unit of claim 1 wherein said container cover has an upward coupling flange raised around said center air hole; said vacuum mount has a bottom coupling groove adapted for coupling to the upward coupling flange of said container cover.

* * * * *